US006668812B2

(12) United States Patent
Javaherian

(10) Patent No.: US 6,668,812 B2
(45) Date of Patent: Dec. 30, 2003

(54) INDIVIDUAL CYLINDER CONTROLLER FOR THREE-CYLINDER ENGINE

(75) Inventor: Hossein Javaherian, Rochester Hills, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 09/756,605

(22) Filed: Jan. 8, 2001

(65) Prior Publication Data

US 2003/0209235 A1 Nov. 13, 2003

(51) Int. Cl.[7] ..... F02D 41/00

(52) U.S. Cl. ..... 123/673; 123/673; 123/406.24; 123/90.15; 701/111

(58) Field of Search ..... 123/406.2, 406.24, 123/436, 673, 90.15; 701/111

(56) References Cited

U.S. PATENT DOCUMENTS

| | | | | | |
|---|---|---|---|---|---|
| 4,483,300 | A | | 11/1984 | Hosaka et al. | 123/489 |
| 4,962,741 | A | | 10/1990 | Cook et al. | 123/489 |
| 5,495,415 | A | * | 2/1996 | Ribbens et al. | 123/436 |
| 5,576,963 | A | * | 11/1996 | Ribbens et al. | 123/436 |
| 5,755,205 | A | * | 5/1998 | Nishimura et al. | 123/436 |
| 6,021,758 | A | * | 2/2000 | Carey et al. | 123/406.24 |
| 6,188,952 | B1 | * | 2/2001 | Serra et al. | 123/436 |

OTHER PUBLICATIONS

Bush et al, "Automatic Control of Cylinder by Cylinder Air–Fuel Mixture Using a Proportional Exhaust Gas Sensor," SAE Paper No. 940149, 1994, pp. 57–71.

Grizzle et al, "Individual Cylinder Air–Fuel Ratio Control with a Single EGO Sensor," *IEEE Transactions on Vehicular Technology*, vol. 40, No. 1, Feb. 1991, pp. 280–286.

Hasegawa et al, "Individual Cylinder Air–Fuel Ratio Feedback Control Using an Observer," SAE Paper No. 940376, 1994, pp. 137–144.

Moraal et al, "Single Sensor Individual Cylinder Air–Fuel Ratio Control of an Eight Cylinder Engine with Exhaust Gas Mixing," Proceedings of the American Control Conference, San Francisco, Jun. 1993, pp. 1761–1767.

* cited by examiner

*Primary Examiner*—Erick Solis
(74) *Attorney, Agent, or Firm*—Kathryn A. Marra

(57) ABSTRACT

A generic technique for the detection of air-fuel ratio or torque imbalances in a three-cylinder engine equipped with either a current production oxygen sensor or a wide-range A/F sensor, or a crankshaft torque sensor, is disclosed. The method is based on a frequency-domain characterization of pattern of imbalances and its geometric decomposition into two basic templates. Once the contribution of each basic template to the overall imbalances is computed, templates of same magnitude of imbalances but of opposite direction are imposed to restore air-fuel ratio (or torque) balance among cylinders. At any desired operating condition, elimination of imbalances is achieved within few engine cycles. The method is applicable to current and future engine technologies with variable valve-actuation, fuel injectors and/or individual spark control.

12 Claims, 9 Drawing Sheets

INDIVIDUAL CYLINDER CONTROLLER FOR THREE-CYLINDER ENGINE

TECHNICAL FIELD

This invention pertains to a method of detecting and correcting air-fuel ratio or torque imbalances in individual cylinders of a three-cylinder engine or banks of three cylinders in a V6 engine using a single sensor. More specifically, this invention pertains to the use of a frequency-domain characterization of the pattern of such imbalances in detecting and correcting them.

BACKGROUND OF THE INVENTION

There is a continuing need for further refinement of air-fuel ratio (A/F) control in vehicular internal combustion engines. At present, A/F is managed by a powertrain control module (PCM) onboard the vehicle. The PCM is suitably programmed to operate in response to driver-initiated throttle and transmission gear lever position inputs and many sensors that supply important powertrain operating parameters. The PCM comprises a digital computer with appropriate processing memory and input-output devices and the like to manage engine fueling and ignition operations, automatic transmission shift operations and other vehicle functions. In the case of such engine operations, the computer receives signals from a number of sensors such as a crankshaft position sensor, and an exhaust oxygen sensor.

Under warmed-up engine operating conditions, the PCM works in a closed loop continuous feedback mode using the voltage signals from an oxygen sensor related to the oxygen content of the exhaust. The crankshaft angular position information from the crankshaft sensor and inputs from other sensors are used to manage timing and duration of fuel injector duty cycles. Zirconia-based, solid electrolyte oxygen sensors have been used for many years with PCMs for closed loop computer control of fuel injectors in applying gasoline to the cylinders of the engine in amounts near stoichiometric A/F. The PCM is programmed for engine operation near the stoichiometric A/F for the best performance of the three-way catalytic converter.

With more strict emission standards gradually phasing in, there is a need for further refinement of automotive technologies for emissions reduction. One such refinement is the use of a linear response (wide-range) A/F sensor in the exhaust pipe(s) in place of the current zirconia switching (nonlinear) oxygen sensor. Experiments have demonstrated that significant reductions in tailpipe $NO_x$ emissions are possible because of the more precise A/F control offered by a linear A/F sensor.

A second refinement is to increase vehicle fuel economy by diluting the air-fuel mixture with excess air (lean burn) or with exhaust gas recirculation (external EGR). The maximum benefit is achieved at the highest dilute limit. However, in a multi-cylinder engine, the limit is constrained by development of partial burns and possibility of misfire in the cylinder(s) containing the leanest mixture. This happens due to maldistribution of air, fuel or EGR in different cylinders. Thus, a new capability for the control of every cylinder air-fuel ratio by software is needed. Here, the intention would be to control only one variable (e.g., air, fuel or spark) to create uniform A/F or torque in all cylinders since only a single variable (e.g., A/F, $O_2$ or torque) would be measured. Clearly, single-loop feedback controllers around various sensors can operate independently to control air, fuel or spark in every cylinder.

Another motivation for all-cylinder A/F control is cost containment. For very low emission applications, fuel injectors of high precision (i.e., very small tolerances of less than 3%) are thought to be required. Achievement of this degree of tolerance, if possible at all, would be costly. A better solution would be to have a software means to compensate for the differences between fuel injectors in real-time operation of the engine. Another source of cylinder imbalances in a multi-cylinder engine is the inherent engine maldistribution due to variable breathing capacities into various cylinders. The air maldistribution can result in A/F or torque imbalances for which a software solution is sought.

Accordingly, it is seen that new emission reduction strategies for automotive gasoline engines would be enabled or enhanced by the development of a process for detecting and correcting fuel, air or spark imbalances between cylinders of a multi-cylinder engine.

SUMMARY OF THE INVENTION

In this invention, a process is provided that would balance A/F or torque amongst all cylinders of a three-cylinder engine or separately in either bank of a V6 engine. The benefits in terms of emissions reduction, fuel economy and driveability will depend on the degree of A/F or torque imbalances present in the engine and is engine dependent. In general, it is estimated that the benefit would depend on exhaust system configuration as well. For example, the benefit in a V6 engine with dual banks of unequal pipe lengths is larger when a single sensor is used for control and when fuel injectors have larger tolerances.

A principal cause, but not necessarily the sole cause, of cylinder A/F imbalances in a fuel-injected engine is differences in the delivery rates of the fuel injectors. Fuel injectors are intricate, precision-made devices, but the delivery rates of "identical" injectors may vary by as much as ±5%. Thus, the normal operation of a set of such injectors may be expected to lead to the delivery of varying amounts of fuel in the respective cylinders even when the PCM specifies identical "injector on" times. If the air flow rate or the exhaust gas recirculation rate is not varying in proportion with the fuel imbalances, there can be significant differences in A/F and/or torque among cylinders.

In a three-cylinder (or dual exhaust system V6) engine, individual cylinder maldistributions of air, fuel and EGR cause fluctuations in the instantaneous oxygen sensor voltages measured downstream at the point of confluence in the exhaust manifold. These $O_2$ sensor voltages are representative of the A/F of the cylinders. The actual A/F signal is periodic with the successive exhausts of the three cylinders, but the periodic pattern remains similar over prolonged engine operation especially if the pattern is due mainly to variances in fuel injector deliveries. Any arbitrary pattern of cylinder to cylinder differences in A/F ratio can be represented by a combination of simpler basic A/F patterns here referred to as "templates". In this notation, a template consists of a unique pattern of −1, 0 and +1 units of A/F or a multiple thereof in each cylinder only. Negative and positive signs imply fuel-rich and fuel-lean A/F, respectively, and 0 implies stoichiometric A/F for a particular cylinder exhaust event. At this point the values of −1 and +1 simply indicate rich and lean A/F without regard to the magnitude of the departure of the ratio from the stoichiometric value, typically about 14.7 for most common gasoline fuels available today.

Obviously, each cylinder could experience a rich or lean A/F when the PCM is trying to control the overall A/F at the stoichiometric ratio. However, it has been determined in connection with this invention that the patterns of all possibilities are not independent of each other. It turns out that the number of independent basic patterns in this representation is equal to the number of cylinders. Specifically for a three-cylinder engine, any unknown pattern of imbalances can be reduced to a combination of three basic patterns $T_1$, $T_2$ and $T_3$ shown in FIG. 1. Referring to FIG. 1, template $T_1$ has the pattern +1, 0, −1 (i.e., lean A/F, stoichiometric A/F and rich A/F) for cylinders 1, 2, 3 respectively. Template $T_2$ is the pattern −1, +1, 0 and template $T_3$ is the pattern +1, +1, +1.

It has been further discovered in connection with this invention that the pattern of unknown three cylinder A/F imbalances with magnitudes (a, b, c) can be uniquely related to the above three templates by appropriate weighting factors ($f_1$, $f_2$, $f_3$) applied to the values of the terms of each template (FIG. 1). Thus, the knowledge of the set of coefficients ($f_1$, $f_2$, $f_3$) is equivalent to knowledge of the unknown values of the imbalances (a, b, c) in the engine's three cylinders. The coefficients may have positive or negative values or the value of zero. Often it is preferred that the coefficients have values expressed as percentages of the cylinder weighting factors of the templates.

It also turns out that that pattern of $T_3$, identically rich or lean in all cylinders, is corrected by normal feedback closed-loop operation of the current $O_2$ sensor and the PCM. Therefore, this template does not need to be used in detecting imbalances a, b and c. As will be shown, the total imbalances under closed loop A/F control can be detected by appropriate mathematical comparison with data compiled from experimentally predetermined values for patterns $T_1$ and $T_2$.

Reference values for patterns $T_1$ and $T_2$ are established on a balanced (i.e., all cylinders initially at stoichiometric A/F or other known A/F) three-cylinder engine by operating the engine with calibrated fuel injectors to intentionally successively impose the two patterns at the desired fuel-rich or fuel-lean levels. This calibration process is conducted at selected representative operational speeds and loads for the engine over a sufficient number of engine cycles to obtain the corresponding $O_2$ sensor output at successive crankshaft positions. In other embodiments of the invention, a wide-range A/F sensor or a torque sensor is used. For example, at each engine speed and load, pattern $T_1$ could be produced by a lean imbalance of +10% of stoichiometric A/F in cylinder #1, a rich imbalance of −10% of the stoichiometric A/F in cylinder #3 while cylinder #2 is operated at the stoichiometric A/F. Then, imbalances of like magnitude could be imposed in accordance with the $T_2$ pattern. Assuming 60 available crankshaft position signals over two crankshaft revolutions (i.e., one engine fueling cycle), oxygen sensor data would be collected by the PCM at each 12° of crankshaft revolution.

The data from $O_2$ (or wide-range A/F or crankshaft torque) sensor for each template $T_1$ and $T_2$, at engine speed (rpm) and load (represented by manifold absolute pressure, MAP, or manifold air flow, MAF), is subjected to discrete Fourier transform (DFT) to determine its frequency spectrum. The discrete spectrum is in terms of phase and magnitude information at various frequencies related to the base engine speed and its higher harmonics. This information, together with interpolated data or suitable analytical equations, is stored in PCM table lookups for reference by the PCM during the cylinder fueling imbalance detection phase. In this case of a bank of three cylinders, the DFT vectors for templates $T_1$ and $T_2$ will roughly have a phase separation of 120°.

Having established reference data for the transformed templates, fuel imbalances in the operating engine can then be detected and corrected as necessary. To the extent that cylinder to cylinder imbalances in fuel injection are due to injector delivery variations, it is expected that such imbalances will follow a regular pattern, and once detected, an appropriate correction may remain effective until further usage of the injectors changes the imbalance. Accordingly, the detection and correction parts of this invention may not have to be run continually. However, as will be seen, they can also be run as frequently as required by the PCM due to speed of convergence and computational efficiency.

The detection process is initiated by the PCM and includes collecting and storing oxygen sensor data at successive crank angle signals over a few engine cycles. One complete fueling cycle providing, for example, 60 data points may be suitable. But it will usually be preferred to collect data over several cycles. This data is subjected to the same Fourier transformation process to obtain the phase and magnitude representing a single imbalance vector.

The detected fuel imbalance vector is mathematically decomposed to determine the respective contributions of the two reference vectors $T_1$ and $T_2$ in the total vector of imbalances measured. In other words, the coordinates of the imbalance vector in terms of the phase angles of the reference vectors and the proportion of their respective magnitudes are determined by known mathematical practices. The conversion of the imbalance vector into two component vectors permits the correction for the fueling imbalances by the PCM. The PCM determines the "opposite" of the two components of imbalances vectors, i.e., vectors that have the same magnitude but are of 180° phase difference, and calculates the fueling corrections that must thereafter be applied to each fuel injector to correct the fuel imbalances otherwise present in the respective cylinders. These fuel injector on-time corrections are applied cycle after cycle until the detected level of imbalances is brought below a given threshold.

As stated, the subject process may be used in response to the signals from a current production exhaust oxygen sensor, a wide-range exhaust A/F sensor, a crankshaft torque sensor or other suitable sensors used by a PCM for fuel, air or spark control in a three-cylinder engine. As is known, fuel control to individual cylinders can be accomplished by PCM control of fuel injector "on time". Similarly, air distribution to the three cylinder banks can be managed by PCM control of air inlet valve actuators. And, in accordance with this invention, detected imbalances in torque from individual cylinders can be corrected by PCM control of fuel or air delivery or spark timing with respect to each cylinder.

In the above-described reference templates, stoichiometric A/F, generally about 14.7 for current commercial gasolines, was used as the mean A/F value because of the wide practice of operating engines at about stoichiometric A/F for best operation of current exhaust catalytic converters. However, if it is desired to operate the engine slightly fuel rich, e.g., A/F=about 10 to 14.7, the mean value for the templates would be a selected value in this range. Similarly, where it is desired to operate in a fuel lean mode, e.g., A/F=about 14.7 to 60, a mean template value in the lean range would be used.

Other objects and advantages of the invention will become apparent from a description of embodiments of the invention which follow.

DESCRIPTION OF THE PREFERRED EMBODIMENT

A strong motivation for detection and correction of individual cylinder fuel imbalances is to improve fuel economy and reduce exhaust emissions cost effectively. Fueling imbalances can possibly be reduced by using fuel injectors of high precision, i.e., specifying injectors with fuel delivery tolerances of less than three percent. Achievement of this high degree of manufacturing precision, if possible, would be costly. In this invention, a method is provided to address this problem in three-cylinder engine banks exhausting to a common exhaust duct by utilization of an existing onboard microprocessor.

As stated in the Summary of Invention section of this specification, any arbitrary pattern of cylinder-to-cylinder differences in A/F ratio can be represented by a combination of simpler basic A/F patterns here referred to as "templates". In this notion, a template consists of a unique pattern of −1, 0 and +1 units of A/F in each cylinder only. The value zero denotes stoichiometric mass air-fuel ratio (A/F), and negative and positive signs imply fuel-rich and fuel-lean A/F, respectively.

Figure 1:
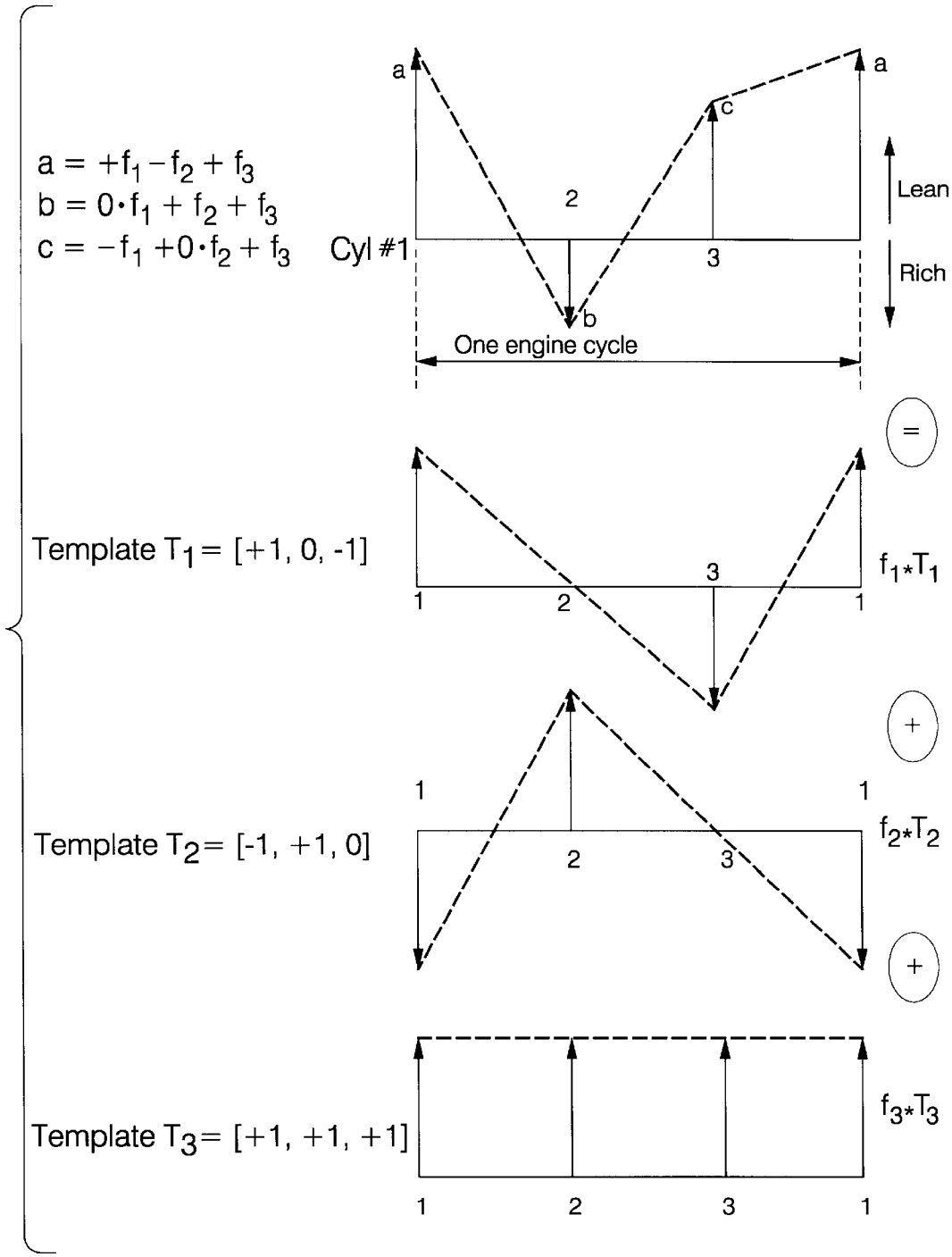
FIG. 1 is a graph of three reference fueling imbalance templates, $T_1$–$T_3$, for a three-cylinder engine used in the practice of this invention. The horizontal axis represents cylinder number, the upward arrows represent fuel lean A/F and the downward arrows represent fuel rich A/F for the respective cylinders around the reference value of stoichiometry. Also shown in FIG. 1 is an unknown fuel imbalance example template with equations showing the contributing relationships of the reference templates to the unknown imbalance template.

For a three-cylinder engine, any unknown pattern of imbalances can be reduced to a combination of three basic patterns $T_1$, $T_2$ and $T_3$ shown in FIG. 1. As seen in FIG. 1, Template 1 has the pattern +1, 0, −1 for cylinders 1, 2 and 3, respectively. This pattern represents a complete fueling cycle for cylinders 1–3, respectively, of the engine although the actual fueling sequence may be in the order of cylinder 1, 3, 2. Template 2 is the pattern −1, +1, 0 for cylinders 1, 2 and 3, respectively, and Template 3 represent the pattern +1, +1, +1.

In the development of this invention, it has been rigorously demonstrated that these three templates provide a basis for detecting any pattern of fueling imbalances in a three-cylinder engine bank. Referring to FIG. 1, the top template illustrates a three-cylinder engine operating situation of unknown A/F imbalances (a, b, c for cylinders 1, 2 and 3, respectively). Any pattern of such unknown cylinder imbalances (whether A/F imbalances or spark timing imbalances) can be uniquely related to the above three templates by appropriate weighting factors ($f_1$, $f_2$, $f_3$) applied respectively to the values of the terms of each template $T_1$, $T_2$ and $T_3$. FIG. 1 shows the applicable equations relating fueling imbalances a, b and c to their cylinder counterparts in the three reference templates. Thus, the knowledge of the set of coefficients ($f_1$, $f_2$, $f_3$) is equivalent to knowledge of the unknown values of the imbalances (a, b, c) in the engine's three cylinders. The coefficients ($f_1$, $f_2$, $f_3$) may have positive or negative values or the value of zero. Often it is preferred that the coefficients have values expressed as percentages of the cylinder weighting factors of the templates.

A close examination of cylinder imbalance templates reveals the following properties. Each template has a discrete frequency spectrum with non-zero magnitudes at a finite number of frequencies only. For templates $T_1$ and $T_2$, the spectrum has two lines only. The first line is at a fundamental frequency $\omega_0$ corresponding to the engine speed. The second frequency is twice the fundamental frequency. Template $T_3$ indicates a uniform A/F across all cylinders and its spectrum has non-zero value only at $\omega=0$. This static component (with weighting factor $f_3$) is usually eliminated by the closed-loop average A/F controller and can be discarded. Therefore, there remain only two unknown template factors $f_1$ and $f_2$.

For $T_1$ and $T_2$, the non-zero magnitudes (at $\omega_0$ and $2\omega_0$) are coupled so that any changes at one frequency will impact the other one, i.e., they increase or decrease together. This implies that one can focus on the contributions at the fundamental frequency $\omega_0$ only. This observation is important as it reduces the sensor bandwidth requirement for imbalances detection and correction. Elimination of imbalances at the fundamental frequency for each template $T_1$ and $T_2$ results in a perfectly balanced A/F in all cylinders.

Figure 7:
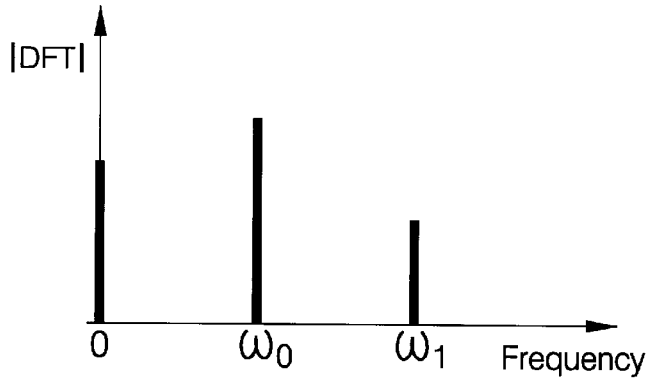
FIG. 7 is a graph illustrating an example of a discrete Fourier transform of A/F imbalances in a three-cylinder engine having spectral lines only at the frequency $\omega_0$ corresponding to the base engine speed and its higher harmonic $\omega_1=2\omega_0$ in addition to the static value at $\omega=0$.

In the presence of A/F imbalances, a Fourier series analysis of the A/F signal indicates that the frequency spectrum of the A/F signal consists of multiple (infinite) harmonics, but the spectrum is dominated by the first harmonic. The first (or fundamental) harmonic $\omega_0$ depends on engine speed. Higher harmonics are integer multiples of the fundamental frequency $\omega_0$. FIG. 7 is a graph illustrating an example of discrete Fourier transform of A/F signal in a three-cylinder engine.

Any single linearly-independent pattern of imbalances chosen from the set {−1, 0, +1} will constitute a possible solution, though incomplete, and will be referred to as a balancing or reference template. In general, to cancel imbalances in a three-cylinder engine, there would exist three templates so that a unique (and complete) solution is obtained. The frequency spectrum of each balancing template, in general, is composed of up to three frequencies. With the average A/F controlled by the main fuel controller in current production systems, the static component of imbalances will become irrelevant and may be excluded. This leaves only two balancing templates with non-zero discrete frequency spectrums consisting of two frequencies only.

Elimination of the first two harmonics alone would result in a complete attenuation of individual cylinder imbalances. Fortunately, these frequencies are always jointly present, and detection of the fundamental frequency is an indication of presence of the second harmonic, too. This will reduce the spectral search centered at the fundamental harmonic only.

In the practice of this invention, exhaust sensor or other sensor signals are subjected to Fourier transforms. For a sensor signal x(n) sampled at discrete time intervals n=0, 1, . . . , N−1, the Fourier transform is defined by the following expression:

$$X(k) = \sum_{n=0}^{N-1} x(n) \cdot e^{-j2\pi kn/N}$$

Here, $j=\sqrt{-1}$ is the complex number, N=total number of data points and k=number of spectral lines in the Fourier transform. The resulting spectrum has non-zero values only at a discrete number of frequencies $\omega_K=2\pi kn/N$ and, hence, is called the Discrete Fourier Transform (DFT). The Discrete Fourier Transform maps N complex numbers x(n) into N complex numbers X(k). In this case, the samples from sensor signal x(n) have real parts only.

For computational efficiency, when the number of sensor data points is a power of 2 (i.e., $N=2^{\nu}$, ν=a positive integer), then there are well-known efficient techniques to reduce the time and the complexity of DFT computations. The technique is called Fast Fourier Transform (FFT). In most practical DFT calculations, the number of samples is taken as powers of two (e.g., 16, 32, 64, 128, etc.), if possible, to expedite DFT calculations.

In an attempt to detect and eliminate individual cylinder imbalances, one can use a single exhaust sensor to measure A/F (or $O_2$ concentration) signal at the point of confluence in the exhaust manifold. The sensor is sampled at a rate compatible with the recovery of the first harmonic and for a length of at least one full engine cycle. A fast or discrete Fourier transform (DFT) of the A/F signal is performed and the amplitude of the first harmonic is computed. Magnitudes larger than a given threshold at each mode indicate a significant imbalance at that mode.

Once the level of imbalances at the frequency of interest has been detected, the corrective templates are imposed individually and simultaneously to reduce the level of total imbalances to near zero. In other words, the control signal uses the logical templates corresponding to various modes and modal shapes (i.e., discrete modes).

By shifting attention from the time-domain to the frequency-domain, the structure of the essential information latent in the A/F signal is revealed. In this method, there is no undue attention to signal details such as high-frequency components and noise effects which are sensitive issues in many time-domain methods for the synthesis of imbalances. It is also important to note that no synchronization signal is being used, which avoids the risks associated with possible synchronization errors or its potential loss. This will also relax the sensor dynamic bandwidth and sampling rate requirements. The method is still effective, up to very high precision, even where the A/F signal may be non-periodic. All these factors point to a method with robustness as its main attribute. This technique is simple to understand and easy to implement and provides a powerful technique for individual cylinder A/F or torque control.

The Technique

With an exhaust sensor of sufficiently wide dynamic-bandwidth, the sensor signal is sampled at a predetermined rate (preferably in tandem with engine events) and for a predetermined period of time (preferably at least one or two engine cycles) and processed according to the following sequence of three steps:

1. Determination of reference templates spectrum phase and magnitude information. This constitutes the calibration step and is carried out a priori (offline) and the data with interpolations is stored as table lookups (or as analytic functions) for real-time individual cylinder fuel control.
2. Detection of imbalances (DFT or FFT analysis).
3. Correction of imbalances.

I. Calibration Step (Determination of the Spectrum of Reference Templates)

Any sequence of cylinder imbalances is first reduced to the minimal constituent modal shapes of two modes at a single (known) frequency but unknown amplitude. Thresholds for the admissible level of imbalances for each mode are also established.

This step constitutes the calibration phase conducted on a representative engine with calibrated fuel injectors initially delivering fuel at stoichiometric A/F, or a suitable known A/F (lean or rich), to each cylinder. The injectors are then controlled to successively impose the fuel imbalance patterns of the two templates $T_1$ and $T_2$, each over the full range of design operating speeds and load levels for the engine. The magnitude of the imbalances is known, preferably in the range of about 5% to 15% of stoichiometric A/F, and preferably the same magnitude of imbalance, whether rich or lean, is imposed for each template. The frequency spectrum of the signal (A/F, $O_2$ or crankshaft torque sensor) in terms of its phase and magnitude information is determined at each representative engine speed and load. This information is then available for storage in PCM table lookups of same engine family.

A discrete Fourier transform (DFT) is used to fill the table lookups at different engine speeds and for various loads (MAP or MAF). A basis for providing interpolated data or analytical expressions for intermediate speeds and loads is also employed. This phase is essentially a calibration requirement and is executed offline. If desired, data for various operating conditions can also be curve-fitted so that a simpler analytic function for the spectrum is derived.

Figure 2A:
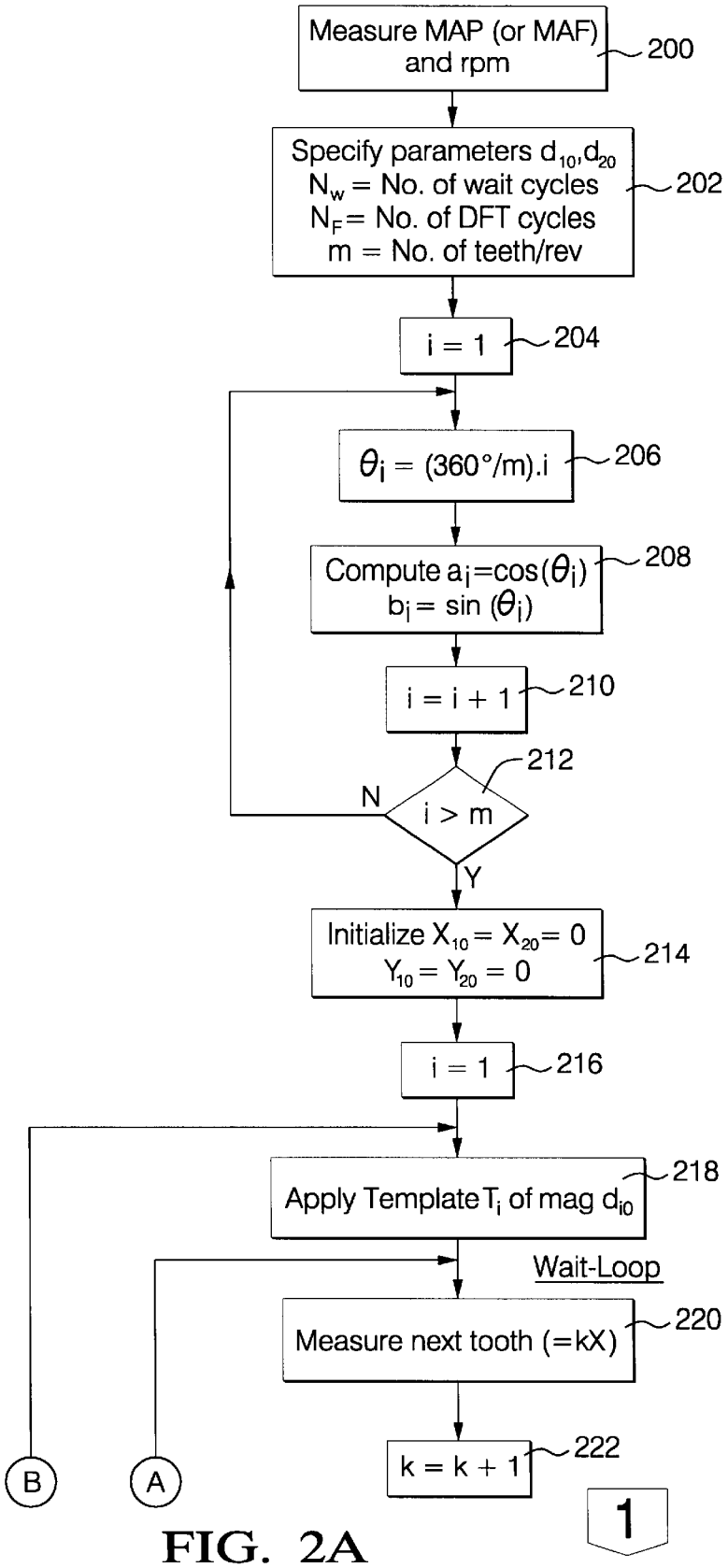
FIGS. 2A–2C are the flow diagrams of a suitable algorithm for the determination of spectrum of reference templates for imbalances in a three-cylinder engine.
Figure 2B:
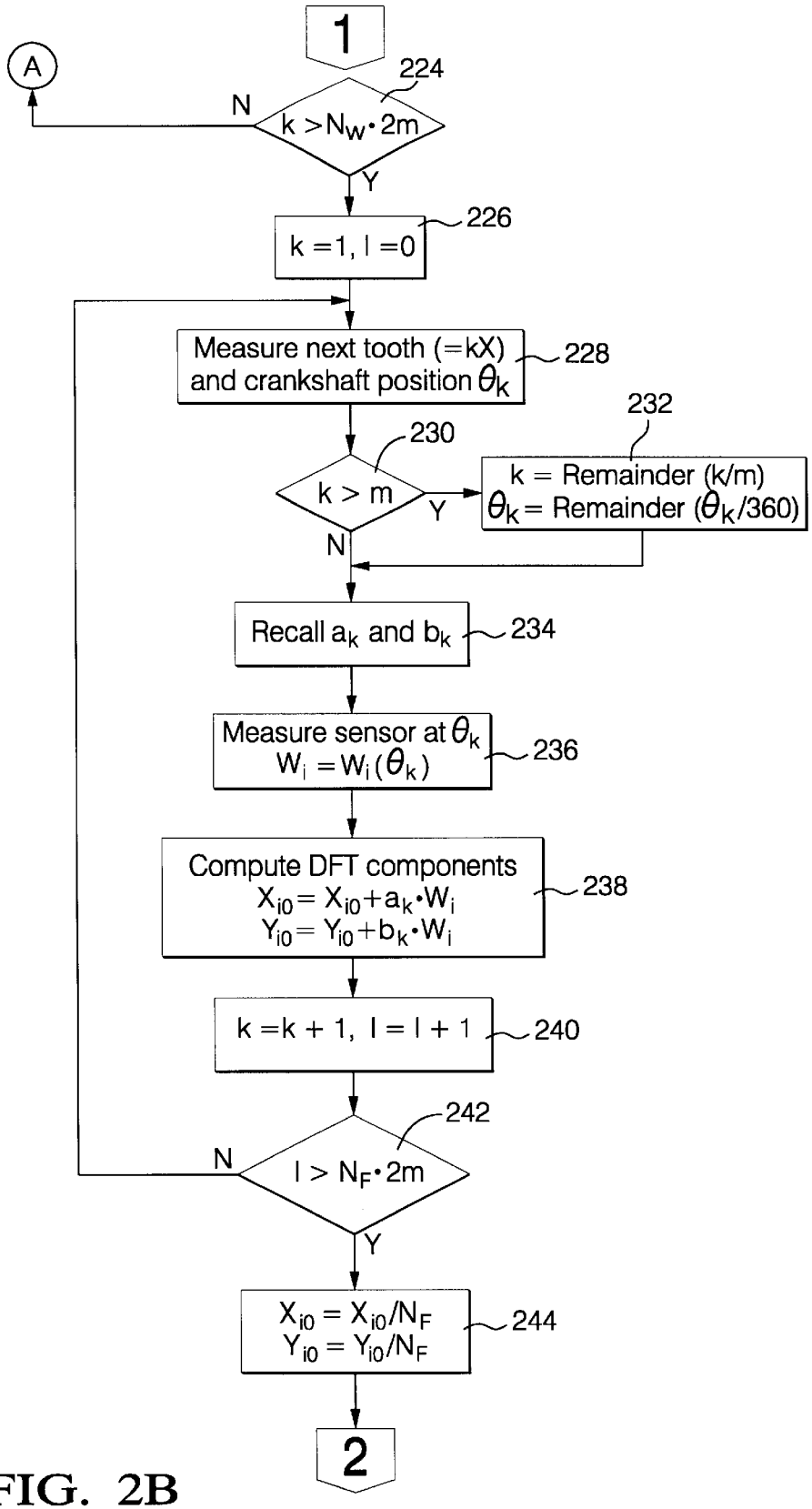
Figure 2C:
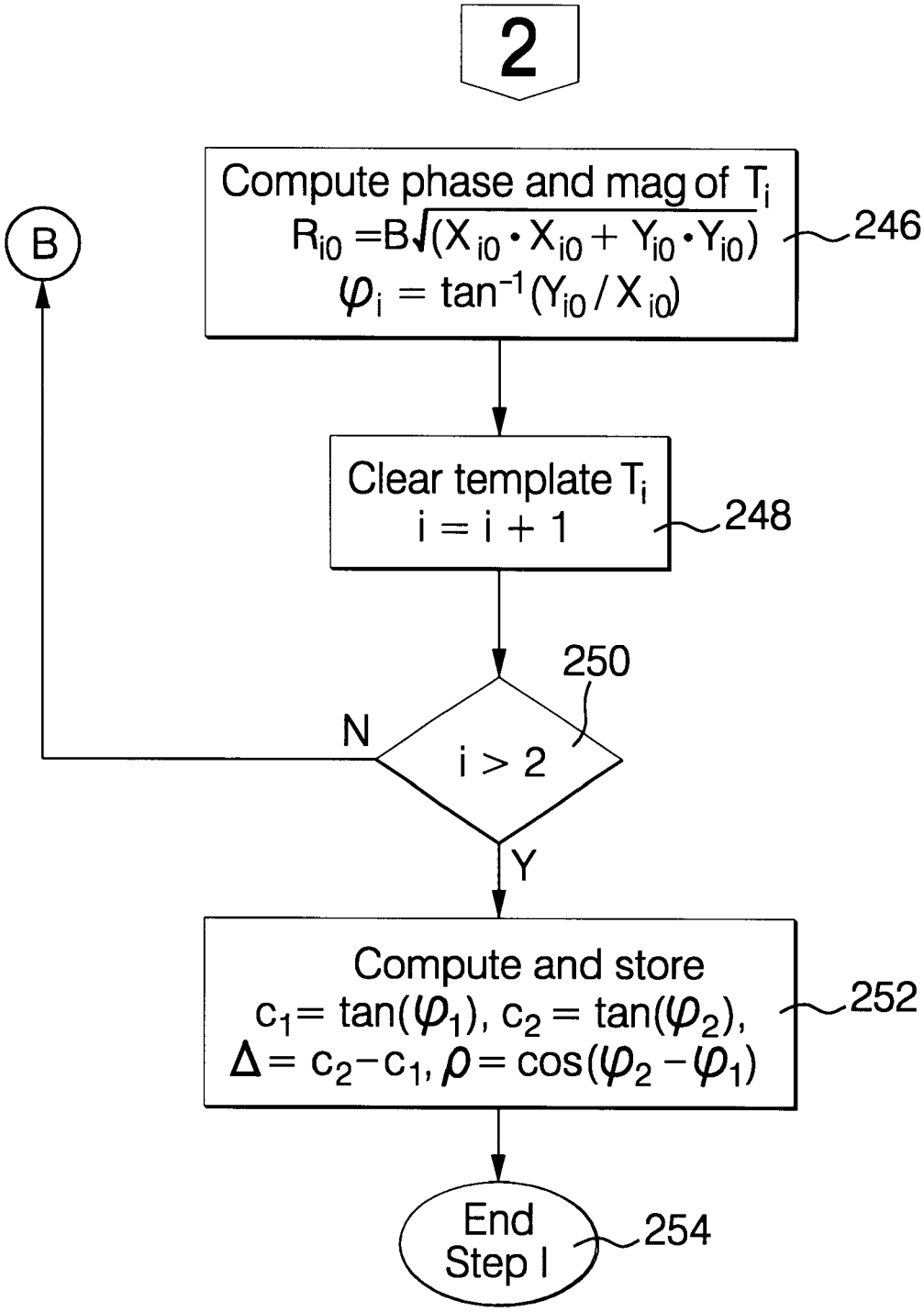

The procedure for the determination of the response of individual templates at any engine speed and load [manifold absolute pressure (MAP) or mass airflow (MAF)] is as follows. Reference will be made to FIGS. 2A through 2C which contain a flowchart of a suitable offline calibration process. The selected or measured engine and MAP or MAF values together with engine speed (rpm) are stored in the PCM as indicated at block 200 of FIG. 2A. In block 202, a set of parameter values regarding the magnitude of templates $T_1$ and $T_2$ named $d_{10}$ and $d_{20}$, respectively, is stored. For example, an imbalance magnitude of 10% of the stoichiometric A/F may be used for each of $d_{10}$ and $d_{20}$. In block 202, the number of wait cycles $N_w$ and the number of signal cycles $N_F$ for execution of DFT computations together with the number of teeth per rotation of crankshaft (m) are recorded. Calculations begin by setting index i=1 in block 204. The process then proceeds as follows:

1. Choose two independent templates $T_1$ & $T_2$. These templates may be characterized by $$T_1=[+1, 0, -1]$$

and $$T_2=[-1, +1, 0]$$

as shown in FIG. 1.

2. Use a suitable crankshaft signal such as the 60X signal in a three-cylinder (L3) engine or the 18X in a V6 engine for DFT calculations. The resolution $\theta_r$ would then be 12° (or 40° in V6). In general, for an engine crankshaft position sensor with m teeth/revolution, the resolution $\theta_r$=360°/m. The A/F (or $O_2$) signal is sampled at $\theta_i=i.\theta_r$ where i=1, . . . ,m (e.g., m=30 for L3 and m=9 for V6) as shown in block 206.
3. Compute $a_i=\cos(\theta_i)$ and $b_i=\sin(\theta_i)$ for all i=1, . . . , m. For any engine family, this calculation will be done once. Results are stored in table lookups for the imbalances detection step. The calculation at respective crankshaft positions is shown in block 208. In block 210, the crankshaft sensor index is incremented and operations continue to block 206 until the answer to query in block 212 is positive, indicating that calculations for all positions are completed.

The values of $\sin(\theta_i)$ and $\cos(\theta_i)$ having been calculated for all crankshaft angle increments of $\theta_i$, the process now proceeds to determining the oxygen sensor outputs for the crankshaft angles of interest. For a positive response in 212, the initial components of imbalances are set to zero as shown in block 214 and adopt a new index i=1 (or 2) for template $T_1$ (or $T_2$) shown in block 216.

4. Apply template $T_1$ imbalances of magnitude $d_{10}$ as shown in block 218 (i=1). To eliminate the effects of fuel transients, it is preferred to wait $N_w$ cycles before measuring the system response. The crankshaft angle is measured (block 220), monitored (block 222) and checked (block 224, FIG. 2B) to insure that the required cycles are elapsed before data collection. Once the required number of wait cycles $N_w$ are elapsed, calculations are transferred to process block 226 where the indexes associated with crank angle and total number of signal cycles for DFT calculations are initialized (blocks 228, 230 and 232).

The $a_k$ and $b_k$ values for current crankshaft angle k are retrieved from memory, block 234. And the oxygen sensor output $W_i$ at the current crank angle $\theta_k$ is stored as $W_i(\theta_k)$, block 236.

For the signal sampled at the rate of m samples/rev, compute the DFT($T_1$) with magnitude $R_{10}=|DFT(T_1)|$ and phase $\phi_1=\angle DFT(T_1)$ or, alternatively, the Cartesian components $X_{10}$ and $Y_{10}$. For example, in Cartesian coordinates, DFT values over one engine cycle are computed from:

$$X_{10}=\Sigma a_i{*}W_1(\theta_i),\ i=1, \ldots m$$

$$Y_{10}=\Sigma b_i{*}W_1(\theta_i),\ i=1, \ldots m$$

where $W_1(\theta_1)$ is the system response (e.g., $O_2$ sensor) at crank angle $\theta_i$ due to the imposed template $T_1$, block 238. In blocks 228–242, the necessary cycle of steps to compute the DFT components of the imbalances are shown. The DFT components are calculated at the respective crank angles, block 240, until the calculation is completed over the specified number of events, block 242. When calculations for the required number of cycles $N_F$ (block 242) is completed, control is transferred to block 244 where the average components $X_{10}$ and $Y_{10}$ are determined. The average values of components $X_{10}$ and $Y_{10}$ are stored in table lookups for the imbalances correction step. With the knowledge of these Cartesian components, the radial components $R_{10}$ and $\phi_1$ are also calculated as in block 246 (FIG. 2C).

5. Similarly, step 4 is repeated for template $T_2$ with magnitude $d_{20}$ by incrementing index i to 2 as in block 248 and repeating all steps in blocks 218–246 (Loop B). Compute DFT($T_2$) with magnitude $R_{20}=|DFT(T_2)|$ and phase $\phi_2=\angle DFT(T_1)$ as in block 246 or, alternatively, the Cartesian components $X_{20}$ and $Y_{20}$.as in block 244. Store $X_{20}$ and $Y_{20}$ in table lookups for the imbalances correction step. Once both templates $T_1$ & $T_2$ have been applied (positive answer to query in block 250) and corresponding responses determined, the process proceeds to block 252.

Figure 8:
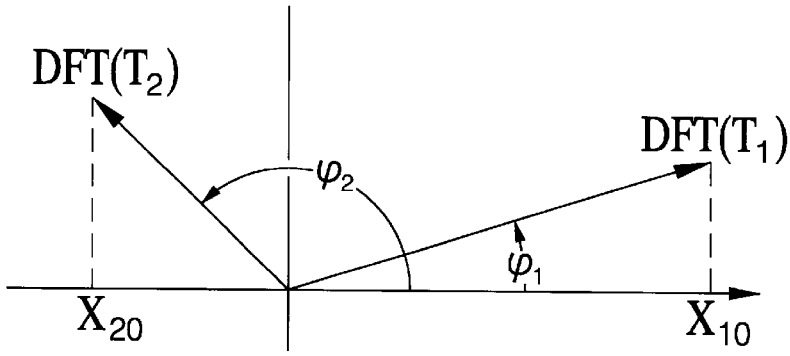
FIG. 8 is a graph illustrating an example of two possible discrete Fourier transform (DFT) vectors $T_1$ and $T_2$ with their respective magnitudes and phase angles $\phi_1$ and $\phi_2$.

FIG. 8 is a graph illustrating an example of two possible DFT($T_1$) and DFT ($T_2$) vectors with their respective magnitudes and phase angles $\phi_1$ and $\phi_2$. In these templates for a three-cylinder engine, the phase angles of the templates are generally 120° apart. Of course, the Cartesian coordinates of these vectors can be determined by projecting on the x and y axes.

6. Compute and store $\Delta=c_2-c_1$ where $c_1=\tan(\phi_1)$ and $c_2=\tan(\phi_2)$ as in block 252. This value is used in the correction phase of the algorithm.
7. Compute and store $\rho=\cos(\phi_2-\phi_1)$ as in block 252. This value is also used in the correction phase of the algorithm. The initial calibration data is now completely available (block 254) for the detection and correction steps to follow.

For $O_2$ sensor-based calibration, due to the non-linearity of the sensor, the calibration has to be carried out at different levels of imposed A/F imbalances. Alternatively, one can approximate the nonlinear calibration curves conservatively and then through iterative corrections (i.e., step III) establish balanced conditions.

II. Detection of Imbalances

Full knowledge of the phase and magnitude of DFT associated with arbitrary unknown imbalances is a powerful tool for detection of imbalances. Any arbitrary pattern of A/F imbalances can be decomposed into two reference templates $T_1$ and $T_2$ plus a constant static component. The static component is automatically eliminated by the average A/F control.

The total imbalance is a superposition of the dual templates of appropriate magnitudes (yet unknown). In this approach, the spectrum of A/F (or $O_2$) sensor signal at the desired frequency dictated by engine speed is determined through the calculation of the signal DFT. This results in a single vector of known phase and magnitude. Clearly, both linearity and superposition principles hold in this method. The Cartesian components of the DFT of the measured signal in real time and computed over at least one engine cycle has the following components:

$$X=\Sigma a_i.W(\theta_i),\ i=1, \ldots ,m$$

$$Y=\Sigma b_i.W(\theta_i),\ i=1, \ldots ,m$$

where $W(\theta_i)$ is the value of the signal, due to unknown imbalances, measured at crank angle $\theta_i$ and index "m" is such that the sensor is measured for at least one full engine cycle (i.e., two engine revolutions) at a minimal sampling rate of 3X (desirable rate ≧6X). Clearly, an L3 engine with 60X surpasses this requirement. The sine and cosine parameters for the crank angles of interest $a_i$ and $b_i$ are entered from previously defined table lookups.

Figure 3:
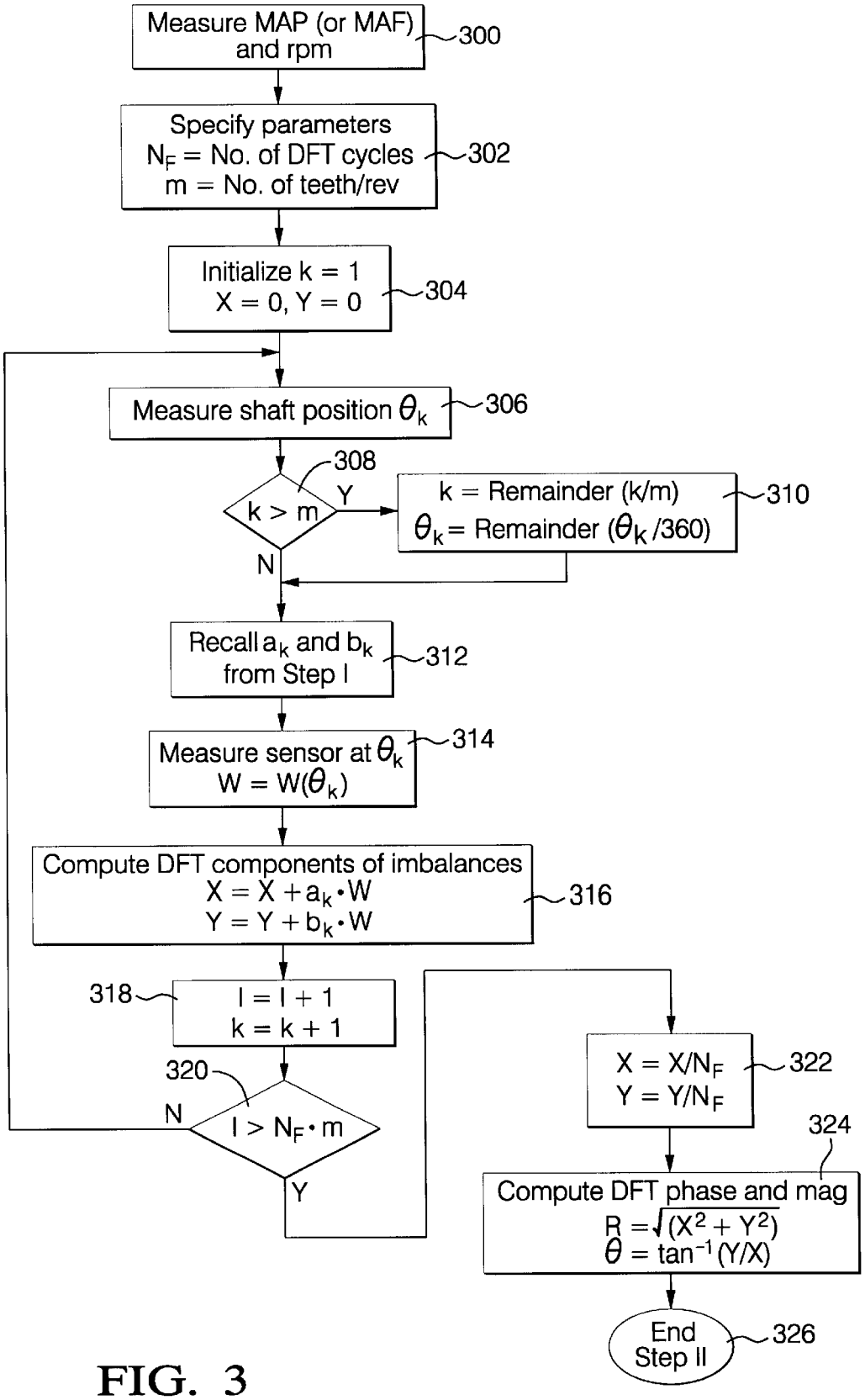
FIG. 3 is a flow diagram of an algorithm for the real time detection of fueling imbalances in a three-cylinder engine.

A complete detailed flowchart of a suitable imbalances detection process (step II) is attached as FIG. 3. Referring to FIG. 3, the detection process begins by measuring manifold pressure (MAP) or intake airflow rate (MAF) and engine speed (rpm) in block 300. Then the number of cycles $N_F$ required for DFT calculation and the number of teeth on the crankshaft encoder (m) are specified, block 302. At block 304, initialization of the index for crank angle (k) and DFT cylinder imbalance components takes place. At every crankshaft sensor tooth k, the crank position ($\theta_k$) is measured (block 306), and when the index exceeds the total number of teeth (block 308), both the index and the teeth angle are adjusted as in block 310. Otherwise, for the current shaft position, the corresponding sine and cosine parameters in block 312 are retrieved from the calibration procedure described above. The oxygen sensor output $W(\theta_k)$ at this crank position $\theta_k$ is recorded in block 314.

Now, the data necessary to compute the current engine operating contribution to DFT of the system response is available in the PCM. The Cartesian coordinates of the DFT components of the imbalances are calculated as described above and as shown in block 316. At this point, the counters for the tooth number (k) and accumulative tooth number (1) are incremented, block 318. If the accumulated tooth number (1) in block 320 indicates that DFT calculation has been completed for the required number of cycles $N_F$, the control transfers to block 322 where the DFT components are computed; otherwise computation returns to block 306. With the Cartesian components of DFT in hand, one can easily compute the radial components of DFT as shown in block 324 and exit the detection step in block 326.

III. Correction of Imbalances

Two methods for the correction of imbalances are proposed each with unique features and advantages. The primary method of correction is referred to as the single-axis projection method and is described first.

Method A: The Single-Axis Projection (SAP) Method

The contributions of individual templates are easily obtained by the decomposition of the DFT vector of the measured signal onto the DFT vectors of individual reference templates $T_1$ and $T_2$. For the three-cylinder engine, the basic templates are always at approximately 120° degrees phase difference, i.e. $\phi_2=\phi_1+120°$.

Figure 9:
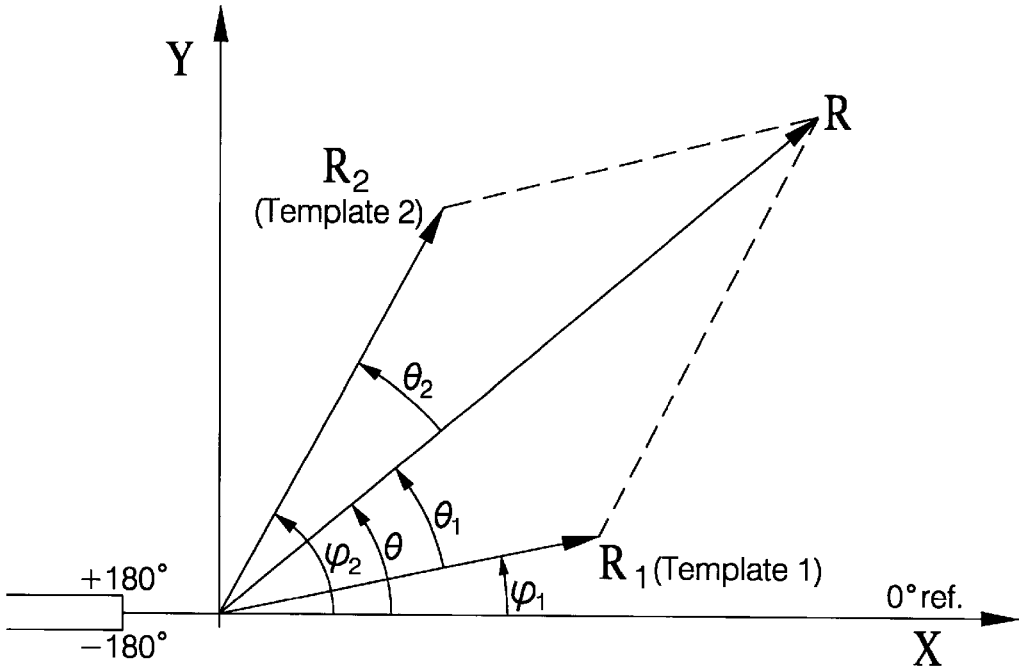
FIG. 9 is a graph illustrating a generic imbalance vector (magnitude R and phase angle $\theta$) and template $T_1$ and $T_2$ contributions with magnitudes $R_1$ and $R_2$ and phase angles $\phi_1$ and $\phi_2$. The angles between the measured imbalance vector and the individual contributing imbalances vectors $T_1$ and $T_2$ are identified as $\theta_1$ and $\theta_2$, respectively.

The Cartesian components of the DFT vector of imbalances are related to the Cartesian coordinates of the two DFT template vectors as follows:

$$X=X_1+X_2$$

$$Y=Y_1+Y_2=X_1.\tan(\phi_1)+X_2.\tan(\phi_2)=c_1X_1+c_2X_2$$

where $X_i$ and $Y_i$ (for i=1 and 2) are Cartesian components of the DFT of the template $T_i$ contributions (as yet unknown), and, X and Y are the measured total DFT components of the unknown imbalances computed from the sensor output. Reference is made to FIG. 9 illustrating the imbalance vector (magnitude R and phase angle θ) and template vectors 1 and 2 with magnitudes $R_1$ and $R_2$ and phase angles $\phi_1$ and $\phi_2$. This figure is a schematic illustration of various DFT vectors of interest. The angles between the measured imbalance vector and the template vectors $T_1$ and $T_2$ are identified as $\theta_1$ and $\theta_2$, respectively.

The unknown components $X_1$ and $X_2$ are now calculated from solving the above set of two equations:

$$X_1=(c_2X-Y)/\Delta,$$

$$X_2=(Y-c_1X)/\Delta$$

where the meaning and values for $c_1$, $c_2$, and Δ were described in the calibration step.

Please note that only a single axis is dealt with at the time (i.e., only $X_i$ or $Y_i$). In occasions when either $c_1$ or $c_2$ assume large values (i.e., either $\phi_1$ or $\phi_2$ approaches 90°), we swap $X_i$ for $Y_i$ in the above equations and proceed.

During the calibration phase, described above, it was seen that the application of a simple template $T_i$ of reference magnitude $d_{10}$ resulted in DFT component $X_{i0}$ for i=1 and 2. With the principle of linearity holding, one can infer that the unknown contribution $d_i$ of each template $T_i$ in the measured imbalance vector is similarly determined by:

$$d_i=X_i/X_{i0}.d_{i0} \text{ for } i=1 \text{ and } 2$$

In other words:

$$d_1=d_{10}.(c_2X-Y)/(\Delta X_{10})$$

$$d_2=d_{20}.(Y-c_1X)/(\Delta X_{20})$$

To restore A/F (or torque) balance to all cylinders, templates $T_i$ of opposite magnitude $-d_1$ are applied. This is achieved by adding appropriate patterns of offsets (related to the template) to average cylinder air valve, spark or fuel pulse width in each cylinder. For example, to apply −6% in $T_1$ with a pattern [+1, 0, −1], 6% is removed from cylinder 1 fuel, 6% is added to cylinder 3, and cylinder 2 fuel is left unchanged (with the firing sequence 1-3-2).

The above single-shot approach would immediately eliminate the A/F (or torque) imbalances in a three-cylinder (or V6 engine with dual exhaust system).

Summary of Method A (SAP) for Correction of Imbalances

Figure 4:
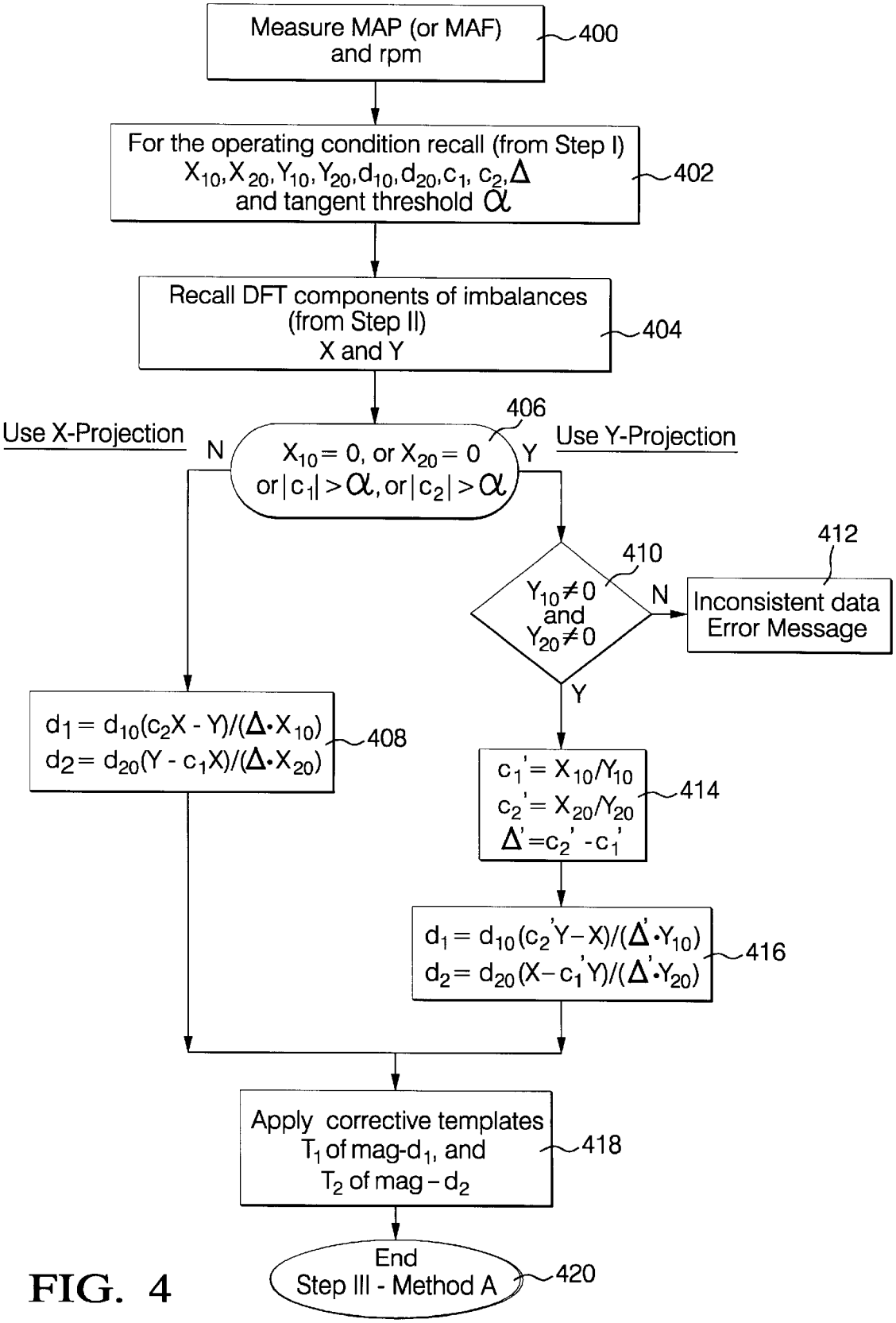
FIG. 4 is a flow diagram of a single-axis method for the real time correction of fueling imbalances for a three-cylinder engine.

FIG. 4 is a flow diagram summarizing the algorithm for performing the correction process by Method A:

1. Measure engine load (MAP) or airflow rate (MAF) and speed (rpm) as in block 400.
2. Recall Δ, $c_i$, $d_{i0}$, $X_{i0}$, $Y_{i0}$ for i=1 and 2 from the calibration step I, and assign a tangent threshold value α (block 402).
3. Recall DFT of imbalances in Cartesian coordinates (X and Y) from the signal output (step II) as in block 404.
4. Check for conditions in block 406. If the answer is negative, then proceed to block 408 to use the X-axis projection. If the answer is positive, go to block 410 (step 6 below) to use the Y-axis projection.
5. Compute contribution $d_i$ of each template $T_i$ in the total imbalances (block 408) from $$d_1=d_{10}.(c_2X-Y)/(\Delta X_{10})$$

$$d_2=d_{20}.(Y-c_1X)/(\Delta X_{20})$$

and go to block 418.

6. Both $X_{10}$ and $X_{20}$ must clearly be non-zero. Otherwise, the roles of $X_{i0}$ and $Y_{i0}$ are properly swapped as in block 414. With the new set of parameters computed in block 414, proceed to block 416 to calculate the contribution $d_i$ of each template. The control is then transferred to block 418.

7. Apply template $T_i$ (for i=1 and 2) of opposite magnitude $-d_i$ to restore A/F (or torque) balance as in block 418. The process for the correction of imbalances at block 420 is now complete.

In this procedure, only a single ($X_{i0}$ or $Y_{i0}$) component of DFT of $T_i$ is used and hence the name single-axis projection (SAP).

In some applications, due to imperfections or inherent properties (such as non-linearity) and variability, it may necessary to iterate a few times to achieve the final goal. This is particularly true for A/F control using a production $O_2$ sensor dominated by strong non-linearity.

The following alternative method for the correction of imbalances is also proposed where some trigonometric function evaluations (or the use of corresponding tabulated values) are required.

Method B: Total Magnitude Method

This is a closed-loop method mostly using the magnitude information. In this technique, it is argued that due to severe sensor degradation (e.g., due to sensor aging), it is possible that the phase information of the computed DFT may not be sufficiently reliable. Distortions in sensor and/or engine characteristics usually have less impact on signal magnitudes and more on the phase information. To make the method more robust, the magnitude information is employed for evaluation of the level of imbalances. Naturally, in the absence of complete phase information, more time and iterations are required to achieve convergence. The method uses geometry to compute the magnitude and involves some calculations of trigonometric functions in real time.

Polar coordinates are used to determine the contribution of individual templates. Once the imbalance vector of measured DFT with magnitude R and phase angle θ is computed, the vector is decomposed onto $T_1$ and $T_2$ templates shown below to determine the contribution of each individual template magnitudes $R_1$ and $R_2$.

Let's define $$\theta_1=\theta-\phi_1,\ \rho=\cos(\phi_2-\phi_1)$$

$$\theta_2=\phi_2-\theta,\ q=\sin(\theta_1)/\sin(\theta_2),\ s=+1/\sqrt{(1+q^2+2.q.\rho)}$$

where $\phi_1$ and $\phi_2$ are known values from the calibration step I.

From the vectorial representation of DFT in FIG. 9, we have:

$$R_1.\sin(\theta_1)=R_2.\sin(\theta_2)$$

$$R^2=R_1.R_1+R_2.R_2+2R_1.R_2.\rho$$

It can readily be shown that the magnitudes of $T_1$ and $T_2$ contributions are $$R_1=R.s \text{ for } T_1$$

$$R_2=R_1.q \text{ for } T_2$$

In the above relation for $R_1$, the following sign convention is adopted:

$$\text{if } \{\theta\geqq\phi_2 \text{ or } \theta\leqq(\phi_2-180)\} \text{ then } s\rightarrow -s.$$

With $R_1$ and $R_2$ calculated, proceed to compute the weighting factors for each template:

$$d_1=d_{10}.R_1/R_{10}=d_{10}.R.s/R_{10}$$

$$d_2=d_{20}.R_2/R_{20}=d_{20}.R.q.s/R_{20}$$

The required correction is then a combination of templates $T_1$ and $T_2$ of magnitude $-d_1$ and $-d_2$, respectively.

Summary of Method B (Total Magnitude) for Correction of Imbalances

Figure 5:
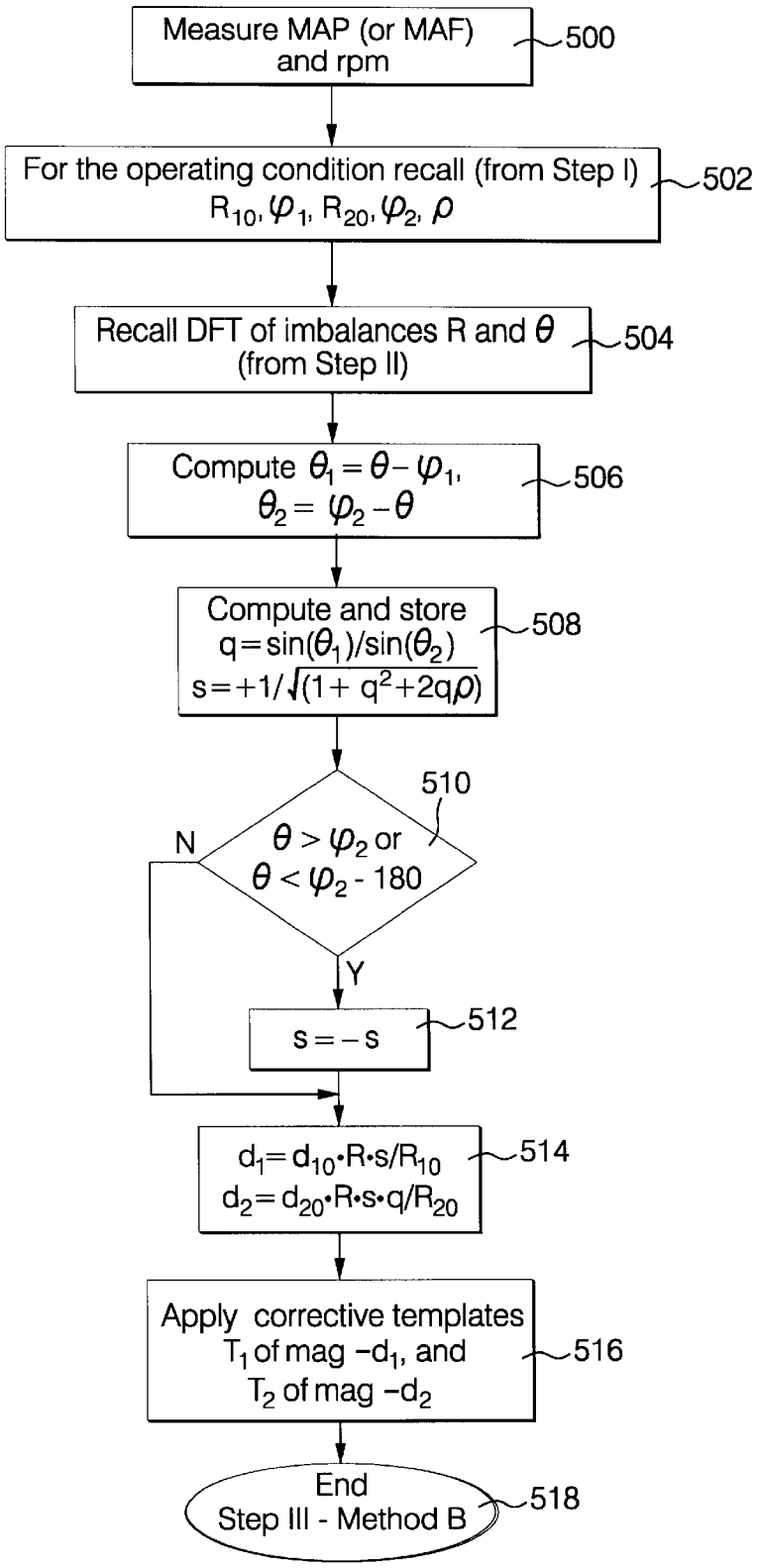
FIG. 5 is a flow diagram of a total magnitude method for the real time correction of fueling imbalances for a three-cylinder engine.

FIG. 5 is a flow diagram summarizing the algorithm for performing the correction process by Method B:

1. Measure engine load (MAP) or airflow rate (MAF) and speed (rpm) as in block 500.
2. Recall ($\phi_1$, $\phi_2$, ρ, $d_{10}$, $d_{20}$, $R_{10}$ and $R_{20}$ from the calibration step I (block 502).
3. Compute the DFT vector (R and θ) of total imbalances from the measured signal from the detection step II (block 504).
4. Compute $\theta_1=\theta-\phi_1$, $\theta_2=\phi_2-\theta$ (block 506).
5. Compute and store $q=\sin(\theta_1)/\sin(\theta_2)$ and $s=+1/\sqrt{(1+q^2+2.q.\rho)}$ as shown in block 508.
6. Check for conditions in query block 510. If true, change the sign of parameter "s" as in block 512.
7. In block 514, calculate $T_1$ contribution from $d_1=d_{10}.R_1/R_{10}=d_{10}.R.s/R_{10}$. Also, calculate $T_2$ contribution from $d_2=d_{20}.R_2/R_{20}=d_{20}.R.s.q/R_{20}$.
8. To correct imbalances, apply templates $T_1$ and $T_2$ of magnitudes $-d_1$ and $-d_2$, respectively, as in block 516. The correction process ends at block 518.

A complete flowchart of the imbalances correction process using the total magnitude method is attached in FIG. 5. As before, a few iterations of the method may be needed to achieve the final goal. This is particularly true when an $O_2$ sensor is used to detect and correct the imbalances at the stoichiometric A/F.

The Control Algorithm

The above techniques provide the basis for a control algorithm for the real-time balancing of individual-cylinder A/F or torque maldistribution. Cylinder imbalances rarely require fast correction and, therefore, a slow control loop of low bandwidth is sufficient. Inherent in the algorithm is its robustness, simplicity and ease of implementation. The algorithm may be used for cylinder A/F maldistribution calibration on a new engine family (off-line application), for its diagnostic value (imbalances including cylinder misfire detection) and also real-time control and attenuation of cylinder maldistributions.

In a four-stroke engine operating at speed N [rpm], one full engine cycle takes $T_o$=120/N [s]. $T_o$ is the time between successive injections in the same cylinder. The fundamental frequency of imbalances is also given by the frequency $\omega_0$32 $1/T_o$ [Hz]. The sensor is sampled at a rate $T_s$ where $T_s<T_o/n$ with n>1 to avoid aliasing though an event-based sampling with synchronization is preferred with the crankshaft encoder (e.g., 60X in a three-cylinder engine). Detection of imbalances at the frequency $\omega_0$ also requires a sensor with the same minimum bandwidth (usually 2–5 times wider). The bandwidth requirement also imposes constraints on the upper limit on engine speed at which the imbalances can effectively be detected.

Figure 6:
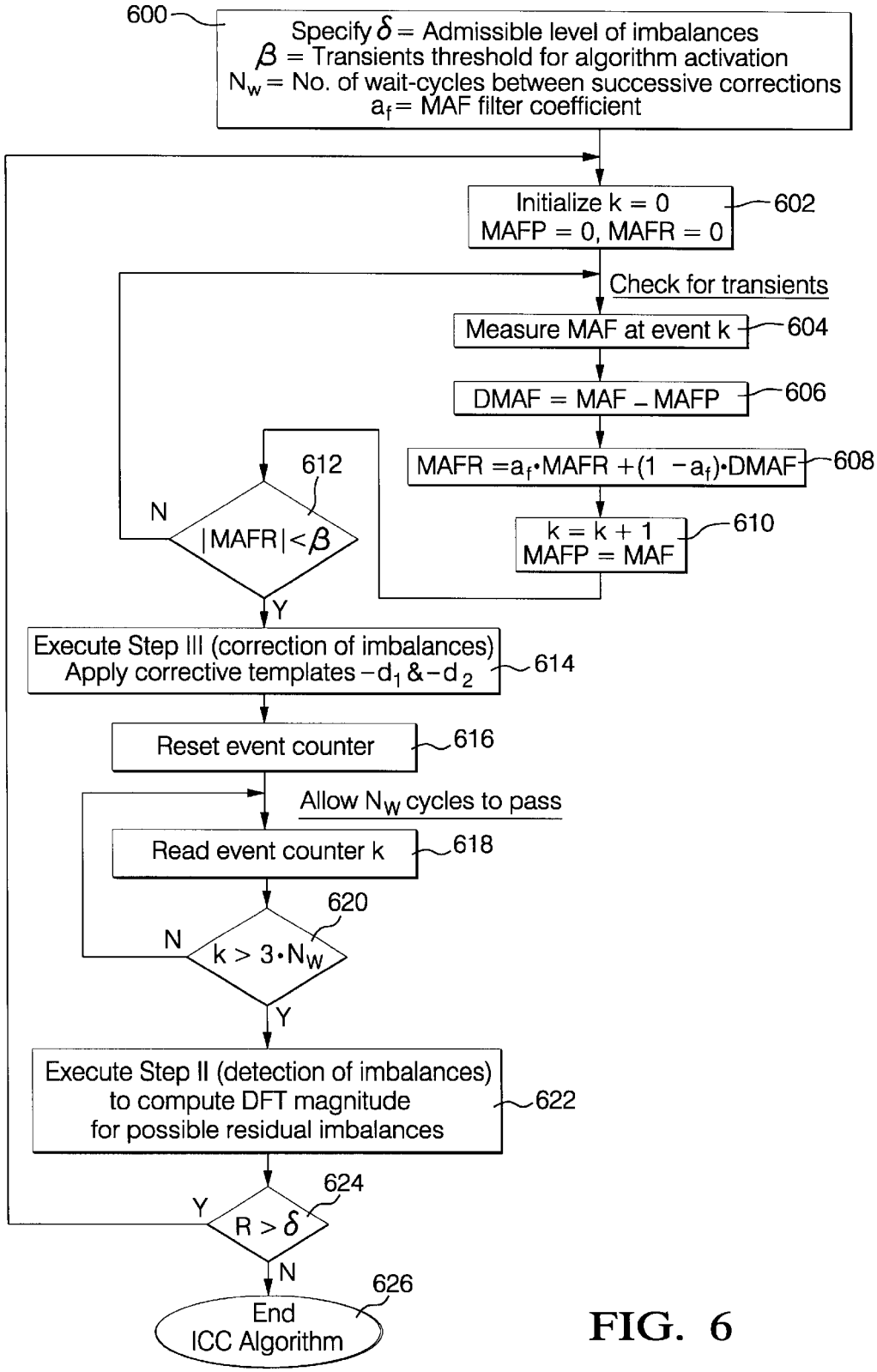
FIG. 6 presents an algorithm flow chart for an overall individual cylinder fuel control incorporating the above-mentioned previous steps.

An overall procedure for individual cylinder control is shown in the flowcharts of FIG. 6 and is outlined below:

1. Establish the DFT threshold δ for the acceptable level of imbalances. The threshold is a function of engine operating conditions, i.e., δ=f(rpm, MAP, MAF, MAT, Mode, . . . ). Also, establish a transient threshold β for algorithm activation and a filter constant $a_f$ for MAF filtering (block 600).
2. Specify the number of wait-cycles ($N_w$) between correction and any subsequent detection to allow transient effects settled. This introduces a dead-time into our algorithm and has two functions: to reduce the impact of A/F (or torque) transients and to allow the effect of air or fuel changes in cylinders to reach the sensor location before any additional corrections are meaningfully attempted (block 600). The wait-time is directly related to the engine and sensor system transportation delays.

3. Initialize index k and variables in block 602.
4. Measure MAF at event k (block 604)
5. Compute the rate of change of MAF (called DMAF) in block 606.
6. Filter DMAF with a coefficient $a_f$ (called MAFR) as in block 608.
7. Increment event k and update old MAF in block 610.
8. Check the rate of change of MAF (or MAP) to be below the threshold value β before enabling the algorithm (block 612). Given the high speed of the algorithm execution, the algorithm can be enabled even under mild transient conditions so that the imbalances are eliminated on the fly.
9. As in block 614, execute the procedure for the correction of imbalances (using either Method A or B in Step III) by computing template $T_1$ and $T_2$ contributions $d_1$ and $d_2$, respectively. Apply templates $T_i$ of opposite magnitude (i.e., $-d_i$) simultaneously to counteract the measured imbalances. Reset the event counter k in block 616.
10. Count events (block 618) and allow for at least $N_w$ engine cycles to pass (block 620). In actual implementation, a wait-cycle three times bigger produced exceptionally good results.
11. Measure imbalances again and verify that imbalances have indeed been removed. For this purpose, execute the procedure for the detection of imbalances (Step II) to determine any possible residual imbalances (block 622). Compute the magnitude of imbalances R.
12. In block 624, if R<δ, take no further action (negligible residual imbalances and hence exit the ICC algorithm to block 626). If the magnitude of DFT after initial correction is still above the threshold δ, then start a new iteration (steps 3 to 12) from block 602. This concludes the process for the individual-cylinder control (ICC) algorithm in a three-cylinder engine.

In all applications, A/F or torque imbalances were detected and corrected in less than one second. This enables one to activate individual cylinder control algorithms even under mild transient operations. The method is robust to system disturbances such as sudden EGR valve openings, load applications and exhaust backpressure changes.

The above description illustrated the use of exhaust oxygen sensors for A/F imbalances detection and correction through fuel injector biasing (i.e., fuel control). The invention is, however, applicable for air control if variable-valve actuation technology is used. Moreover, in conjunction with a crankshaft torque sensor, the disclosed techniques can also be used for the elimination of torque imbalances (i.e., torque control). Thus, while the invention has been described in terms of a few specific examples, it is apparent that other forms could readily be adapted by one skilled in the art, and the invention is limited only by the scope of the following claims.

What is claimed is:

1. A method of detecting and correcting fuel delivery imbalances to the individual cylinders of a three-cylinder group of an engine for a vehicle comprising said engine, fuel injectors for delivering fuel to said cylinders, an air-fuel ratio (A/F) sensor or an $O_2$ sensor for detecting an engine output responsive to the amount of fuel delivered to said cylinders, and an engine control module comprising a computer, the functions of said module including timing and duration of the fuel deliveries of said fuel injectors, said method being executed by said computer and comprising collecting a time sequential series of signals from a said sensor over at least one engine cycle at the current engine speed and load, converting said series of signals by discrete Fourier transform to a vector of A/F imbalances, in the frequency domain, related to said fuel delivery imbalances, said vector having a determined magnitude and phase angle, retrieving two fuel imbalance reference vectors of known magnitude and phase corresponding to the discrete Fourier transform of two nominal fuel imbalance patterns obtained during engine calibration and stored in the memory of said computer for the current engine speed and load, projecting said vector of A/F imbalances onto said two fuel imbalance reference vectors, determining the contributions in said A/F imbalance vector attributable to the two nominal fuel imbalance reference patterns, and applying, in each cylinder of the engine, fuel quantities of opposite magnitude to each of the contributions so determined to correct the fuel imbalance.

2. A method as recited in claim 1 further comprising determining the magnitude only of said contributions of said fuel imbalance reference vectors and using the opposites of said contributions of said vectors to correct fuel delivery to said cylinders.

3. A method as recited in either claim 1 or 2 comprising predetermining, for each of representative engine speeds and loads, said two fuel imbalance reference vectors by a method comprising, applying a first pattern of fuel imbalances to said cylinders, said first pattern producing respectively a lean A/F of size $f_1$, stoichiometric A/F and rich A/F of size $f_1$ in said cylinders and obtaining a first time sequential series of signals from a said A/F sensor or $O_2$ sensor related to said imbalances over at least one engine cycle, converting said first series of signals by discrete Fourier transform to a first reference vector of fuel imbalances, in the frequency domain, related to said first pattern of fuel delivery imbalances at the current engine speed and load, said first reference vector having a first magnitude and phase angle applying a second pattern of fuel imbalances to said cylinders, said second pattern producing respectively a rich A/F of size $f_2$, a lean A/F of size $f_2$, and stoichiometric A/F in said cylinders and obtaining a second time sequential series of signals from a said A/F sensor or $O_2$ sensor related to said imbalances over at least one engine cycle, and converting said second series of signals by discrete Fourier transform to a second reference vector of fuel imbalances, in the frequency domain, related to said second pattern of fuel delivery imbalances at the current engine speed and load, said second reference vector having a second magnitude and phase angle.

4. A method as recited in claim 3 in which the average stoichiometric mass A/F of value 14.7 is replaced as the mean value in reference templates for said reference vectors with a fuel lean value in the range of A/F=about 14.7 to 60, or a fuel rich value in the range A/F=about 10 to 14.7, and the signal of an A/F sensor is used for the purpose of feedback control.

5. A method of detecting and correcting air delivery imbalances to the individual cylinders of a three-cylinder group of an engine for a vehicle comprising said engine, valve actuators for delivering air to said cylinders, an air-fuel ratio (A/F) sensor or $O_2$ sensor for detecting an engine output responsive to the amount of air delivered to said cylinders, and an engine control module comprising a computer, the functions of said module including valve timing and lift for air deliveries of said valve actuators, said method being executed by said computer and comprising collecting a time sequential series of signals from a said sensor over at least one engine cycle at the current engine speed and load, converting said series of signals by discrete Fourier transform to a vector of A/F imbalances, in the frequency domain, related to said air delivery imbalances, said vector having a determined magnitude and phase angle, retrieving two air imbalance reference vectors of known magnitude and phase corresponding to the discrete Fourier transform of two nominal air imbalance patterns obtained during engine calibration and stored in the memory of said computer for the current engine speed and load, projecting said vector of A/F imbalances onto said two air imbalance reference vectors, determining the contributions in said A/F imbalance vector attributable to the two nominal air imbalance reference patterns, and applying, in each cylinder of the engine, air quantities of opposite magnitude to each of the contributions so determined to correct the air imbalance.

6. A method as recited in claim 5 further comprising determining the magnitude only of said contributions of said air imbalance reference vectors and using the opposites of said contributions to correct air delivery to said cylinders.

7. A method as recited in either claim 5 or 6 comprising predetermining, for each of representative engine speeds and loads, said two air imbalance reference vectors by a method comprising, applying a first pattern of air imbalances to said cylinders, said first pattern producing respectively a lean A/F of size $f_1$, stoichiometric A/F and rich A/F of size $f_1$ in said cylinders and obtaining a first time sequential series of signals from a said A/F sensor or $O_2$ sensor related to said imbalances over at least one engine cycle, converting said first series of signals by discrete Fourier transform to a first reference vector of air imbalances, in the frequency domain, related to said first pattern of air delivery imbalances at the current engine speed and load, said first reference vector having a first magnitude and phase angle, applying a second pattern of air imbalances to said cylinders, said second pattern producing respectively a rich A/F of size $f_2$, a lean A/F of size $f_2$, and stoichiometric A/F in said cylinders and obtaining a second time sequential series of signals from a said A/F sensor or $O_2$ sensor related to said imbalances over at least one engine cycle, and converting said second series of signals by discrete Fourier transform to a second reference vector of air imbalances, in the frequency domain, related to said second pattern of air delivery imbalances at the current engine speed and load, said second reference vector having a second magnitude and phase angle.

8. A method as recited in claim 7 in which the average stoichiometric mass A/F of value 14.7 is replaced as the mean value in reference templates for said reference vectors with a fuel lean value in the range of A/F=about 14.7 to 60, or a fuel rich value in the range A/F=about 10 to 14.7, and the signal of an A/F sensor is used for the purpose of feedback control.

9. A method of detecting and correcting air, fuel or spark delivery imbalances to the individual cylinders of a three-cylinder group of an engine for a vehicle comprising said engine, valve actuators system for delivering air, fuel injectors system for delivering fuel and spark ignition system for delivery of engine ignition, to said cylinders, a crankshaft torque sensor for detecting an engine output responsive to the amount of air, fuel and spark delivered to said cylinders, and an engine control module comprising a computer, the functions of said module including valve timing and lift for air deliveries of said valve actuators, fuel injection timing and duration for fuel delivery and spark timing control for engine ignition, said method being executed by said computer and comprising collecting a time sequential series of signals from said torque sensor over at least one engine cycle at current engine speed and load, converting said series of signals by discrete Fourier transform to a vector of torque imbalances, in the frequency domain, related to said air, fuel or spark delivery imbalances, said torque imbalance vector having a determined magnitude and phase angle, retrieving two air, fuel or spark delivery imbalance reference vectors of known magnitude and phase corresponding to the discrete Fourier transform of two nominal air, fuel or spark delivery imbalance patterns obtained during engine calibration and stored in the memory of said computer for the current engine speed and load, projecting said vector of torque imbalances onto said two air, fuel or spark imbalance reference vectors, determining the contributions in said torque imbalance vector attributable to the two nominal air, fuel or spark delivery imbalance reference patterns, and applying, in each cylinder of the engine, air, fuel or spark quantities of opposite magnitude to each of the contributions so determined to correct the torque imbalance.

10. A method as recited in claim 9 further comprising determining the magnitude only of said contributions of said air, fuel or spark imbalances reference vectors and using the opposites of said contributions of said vectors to correct air, fuel or spark delivery to said cylinders.

11. A method as recited in either claim 9 or 10 comprising predetermining, for each of representative engine speeds and loads, said two air, fuel or spark delivery imbalance reference vectors by a method comprising, applying a first pattern of air, fuel or spark delivery imbalances to said cylinders, said first pattern producing respectively an above-average torque of size $f_1$, an average torque and a below-average torque of size $f_1$ in said cylinders and obtaining a first time sequential series of signals from a said torque sensor related to said imbalances over at least one engine cycle, converting said first series of signals by discrete Fourier transform to a first reference vector of air, fuel or spark delivery imbalances, in the frequency domain, related to said first pattern of air, fuel or spark delivery imbalances at the current engine speed and load, said first reference vector having a first magnitude and phase angle, applying a second pattern of air, fuel or spark imbalances to said cylinders, said second pattern producing respectively an above-average torque of size $f_2$, a below-average torque of size $f_2$, and an average torque in said cylinders and obtaining a second time sequential series of signals from a said torque sensor related to said imbalances over at least one engine cycle, and converting said second series of signals by discrete Fourier transform to a second reference vector of air, fuel or spark delivery imbalances, in the frequency domain, related to said second pattern of air, fuel and spark delivery imbalances at the current engine speed and load, said second reference vector having a second magnitude and phase angle.

12. A method as recited in claim 11 in which the average stoichiometric mass A/F of value 14.7 is replaced as the mean value in reference templates for said reference vectors with a fuel lean value in the range of A/F=14.7 to 60, or a fuel rich value in the range A/F=10 to 14.7, and the signal of an A/F sensor is used for the purpose of feedback control.

* * * * *